US007306546B2

(12) United States Patent
Lo

(10) Patent No.: US 7,306,546 B2
(45) Date of Patent: Dec. 11, 2007

(54) LINKAGE STRUCTURE OF A TREADMILL

(75) Inventor: Pai Hua Lo, Tanzih Township, Taichung County (TW)

(73) Assignee: P & F Brother Industrial Corporation, Taichung (TW)

( * ) Notice: Subject to any disclaimer, the term of this patent is extended or adjusted under 35 U.S.C. 154(b) by 781 days.

(21) Appl. No.: 10/836,215

(22) Filed: May 3, 2004

(65) Prior Publication Data

US 2005/0245359 A1 Nov. 3, 2005

(51) Int. Cl.
*A63B 22/02* (2006.01)
*A63B 22/04* (2006.01)

(52) U.S. Cl. ..... 482/52; 482/54

(58) Field of Classification Search ..... 482/51–53, 482/54, 70, 79–80
See application file for complete search history.

(56) References Cited

U.S. PATENT DOCUMENTS 4,204,673 A * 5/1980 Speer, Sr. ..... 482/5
5,277,677 A * 1/1994 Terauds ..... 482/53
5,336,146 A * 8/1994 Piaget et al. ..... 482/54
5,538,489 A * 7/1996 Magid ..... 482/54
5,626,539 A * 5/1997 Piaget et al. ..... 482/54
5,669,856 A * 9/1997 Liu ..... 482/51
6,017,294 A * 1/2000 Eschenbach ..... 482/52
6,461,279 B1 * 10/2002 Kuo ..... 482/54
6,569,062 B2 * 5/2003 Wang et al. ..... 482/54
6,893,383 B1 * 5/2005 Chang et al. ..... 482/54
7,097,593 B2 * 8/2006 Chang ..... 482/54

* cited by examiner

*Primary Examiner*—Stephen R. Crow
(74) *Attorney, Agent, or Firm*—Rosenberg, Klein & Lee

(57) ABSTRACT

A linkage structure of a treadmill, including a frame assembly and two tread board racks pivotally disposed on the frame assembly side by side. Two buffering cylinders are disposed between the tread board racks and the frame assembly. Two support arms are respectively pivotally connected with the tread board racks and slidably mounted in the frame assembly. The support arms are respectively pivotally connected with two linkages. Two ends of the two linkages distal from the support arms are respectively pivotally connected with two ends of a linking rack. The linking rack is pivotally mounted in the frame assembly. Via the support arms, the linkages and the linking rack, the side by side arranged tread board racks are drivingly connected with each other to move in reverse directions.

7 Claims, 7 Drawing Sheets

LINKAGE STRUCTURE OF A TREADMILL

BACKGROUND OF THE INVENTION

The present invention is related to an improved linkage structure of a treadmill, and more particularly to a linkage structure of a treadmill in which two side by side arranged tread board frames are stably drivingly connected with each other to reversely alternately swing.

In a conventional treadmill, two tread boards are independently pivotally disposed on a seat body. Each tread board is equipped with a buffering restoring cylinder. After a user treads the tread boards, the buffering restoring cylinders buffer and restore the tread boards. According to such structure, the two tread boards are independently operated without being drivingly connected with each other. This leads to inconvenience in use of the treadmill.

SUMMARY OF THE INVENTION

It is therefore a primary object of the present invention to provide an improved linkage structure of a treadmill in which via two support arms, two linkages and a linking rack, two side by side arranged tread board racks are stably drivingly connected with each other to move in reverse directions.

It is a further object of the present invention to provide the above linkage structure of the treadmill in which the linking rack is pivotally disposed on a middle beam in form of a telescopic rod. By means of telescoping the middle beam, the position of the linking rack is adjustable to change the amplitude of tread board racks.

According to the above objects, the linkage structure of the treadmill includes a frame assembly and two tread board racks pivotally disposed on the frame assembly side by side. The tread board racks are respectively looped with two circulating belts which are driven by a driving unit to circulate. Two buffering cylinders are respectively disposed between the tread board racks and the frame assembly. Two support arms are respectively pivotally connected with the tread board racks and slidably mounted in the frame assembly. The support arms are respectively pivotally connected with two linkages. Two ends of the two linkages distal from the support arms are respectively pivotally connected with two ends of a linking rack. The linking rack being pivotally mounted in the frame assembly, whereby the side by side arranged tread board racks are drivingly connected.

The present invention can be best understood through the following description and accompanying drawings wherein:

DETAILED DESCRIPTION OF THE PREFERRED EMBODIMENTS

Figure 1:
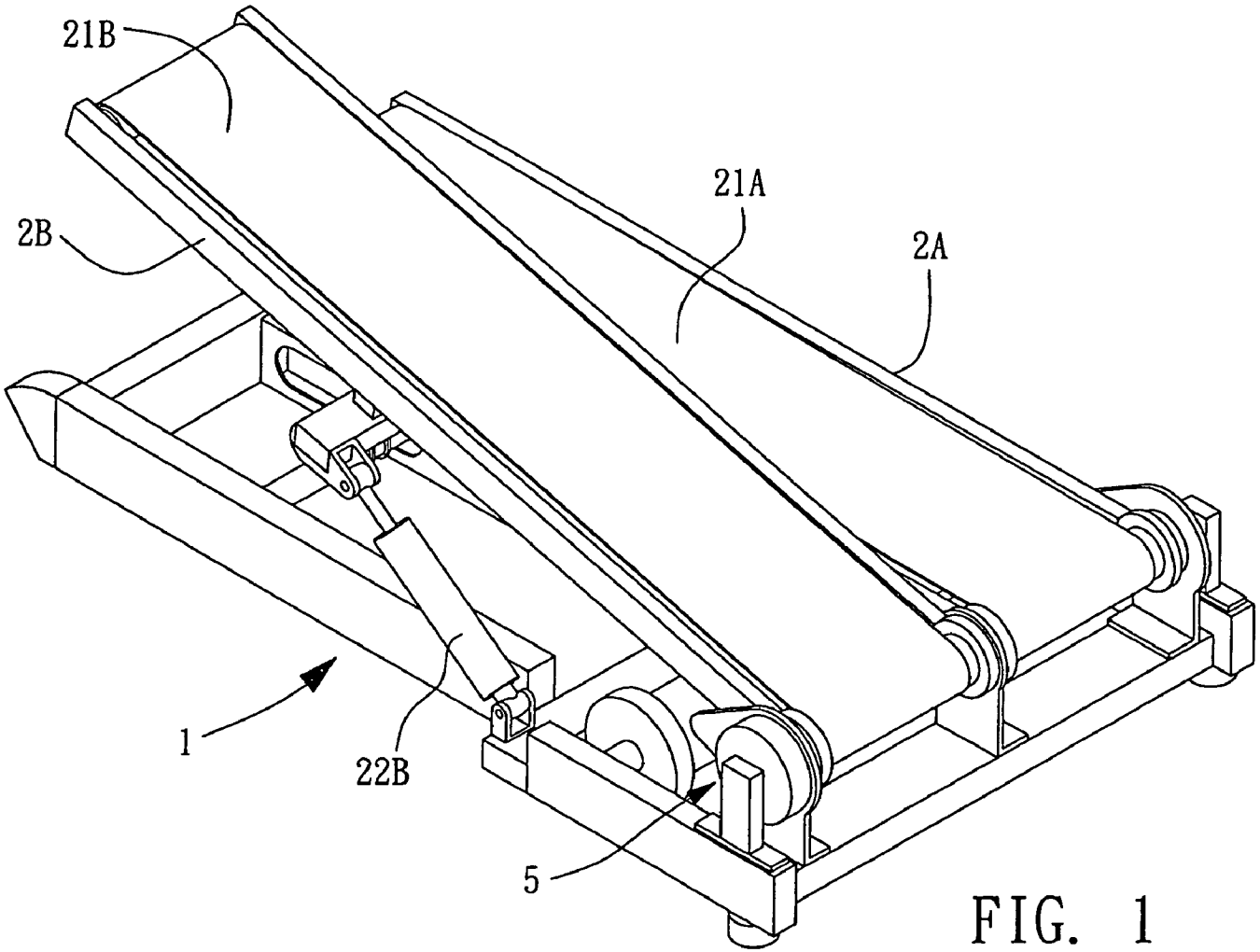
FIG. 1 is a perspective view of the present invention.
Figure 2:
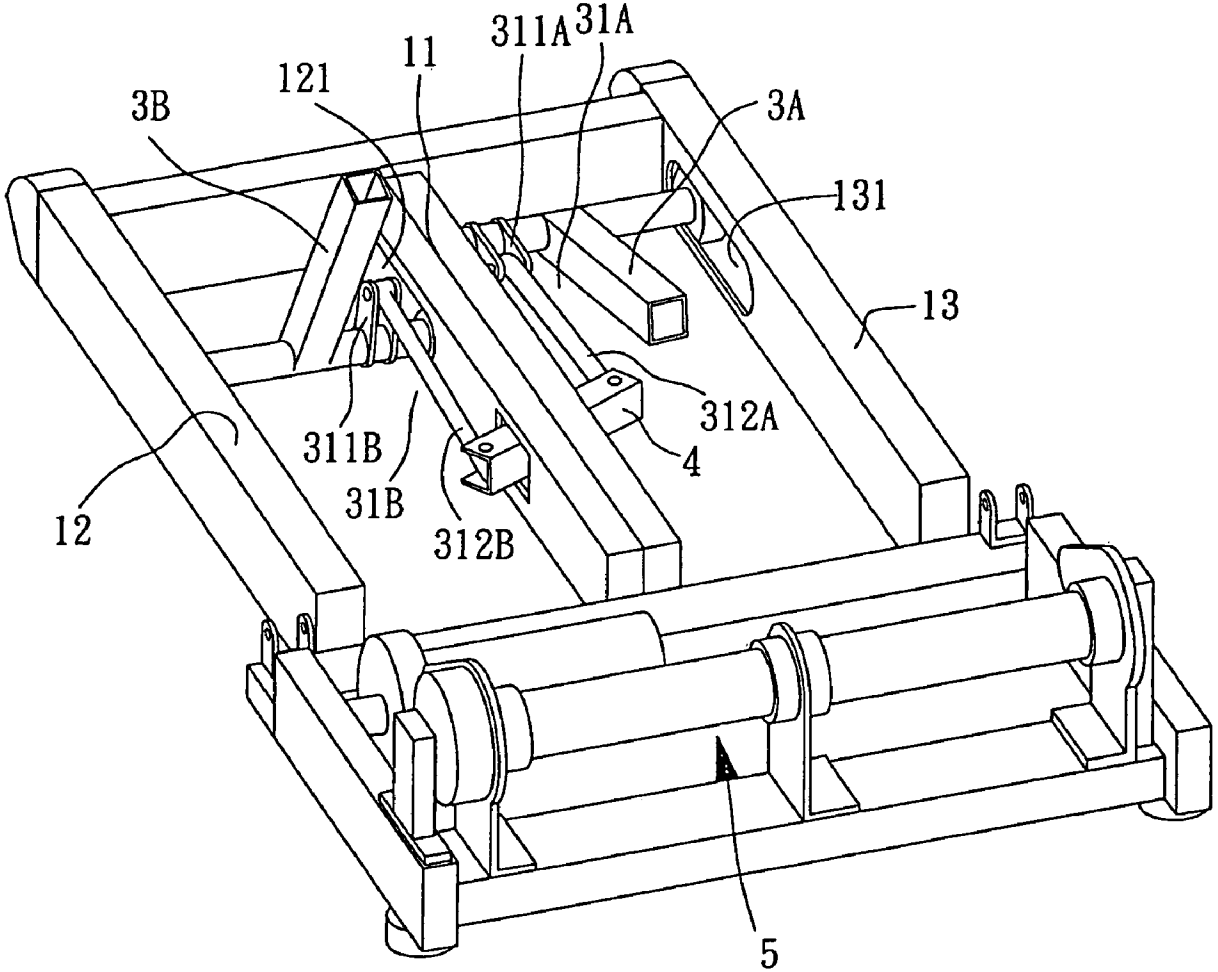
FIG. 2 is a perspective view of the support arms, linkages and linking rack of the present invention.
Figure 3:
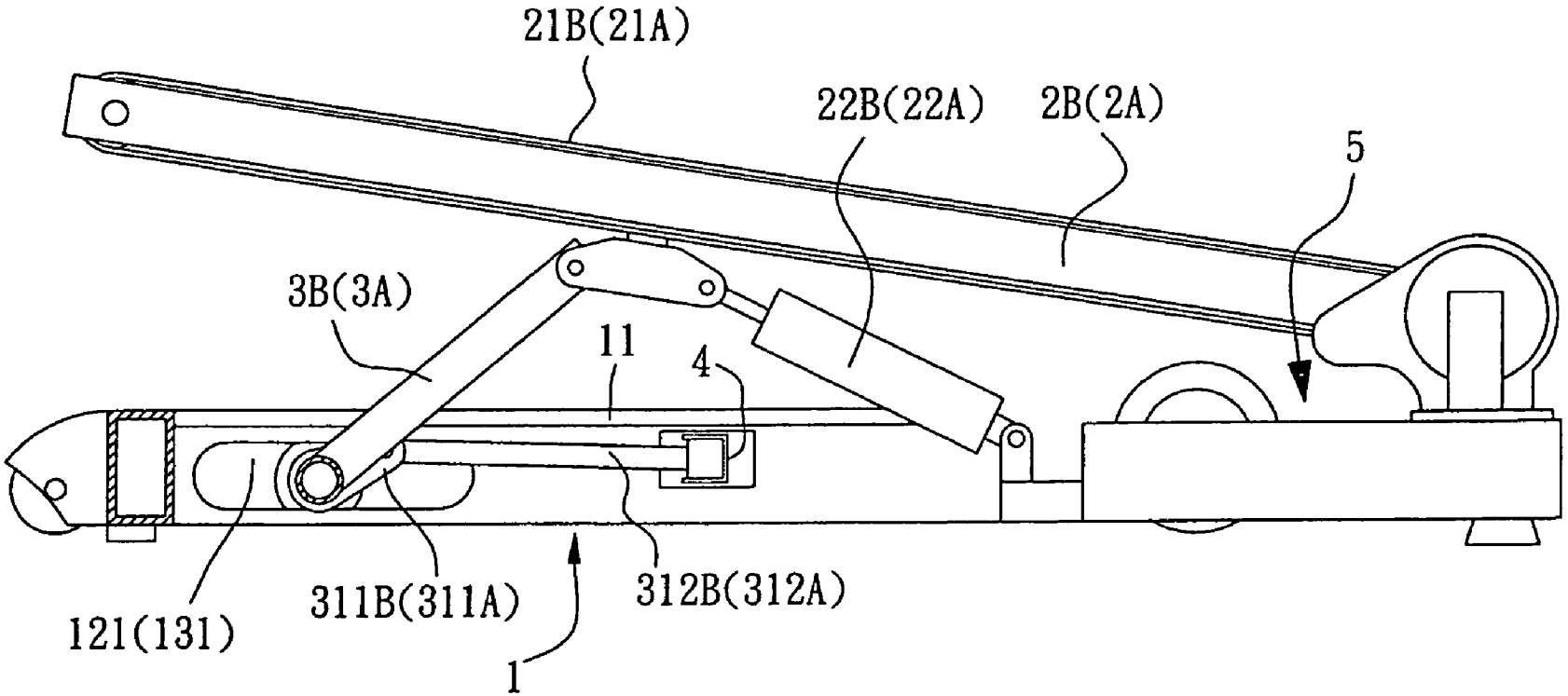
FIG. 3 is a side view of the present invention.

Please refer to FIGS. 1 to 3. The linkage structure of the treadmill of the present invention includes a frame assembly 1. Two tread board racks 2A, 2B are pivotally disposed on the frame assembly 1 side by side. The tread board racks 2A, 2B are respectively looped with two circulating belts 21A, 21B which are driven by a driving unit 5 to rotate. Two buffering cylinders 22A, 22B are disposed between the tread board racks 2A, 2B and the frame assembly 1. In addition, two support arms 3A, 3B are respectively pivotally connected with the tread board racks 2A, 2B and slidably mounted in the frame assembly 1. In this embodiment, a middle beam 11 is disposed at the center of the frame assembly 1 to divide the frame assembly 1 into a left frame 12 and a right frame 13. The left and right frames 12, 13 are respectively equipped with two slide rails 121, 131 corresponding to the support arms 3A, 3B. The support arms 3A, 3B can be slid along the slide rails 121, 131. The support arms 3A, 3B are respectively pivotally connected with two linkages 31A, 31B. Each linkage 31A, 31B includes a rocker arm 311A, 311B fixed on the support arm 3A, 3B and a link 312A, 312B pivotally connected with the rocker arm 311A, 311B. The links 312A, 312B are respectively pivotally connected with two ends of a linking rack 4 which is pivotally mounted on the middle beam 11 of the frame assembly 1. Accordingly, the tread board racks 2A, 2B are drivingly connected with each other to move in reverse directions.

Figure 4:
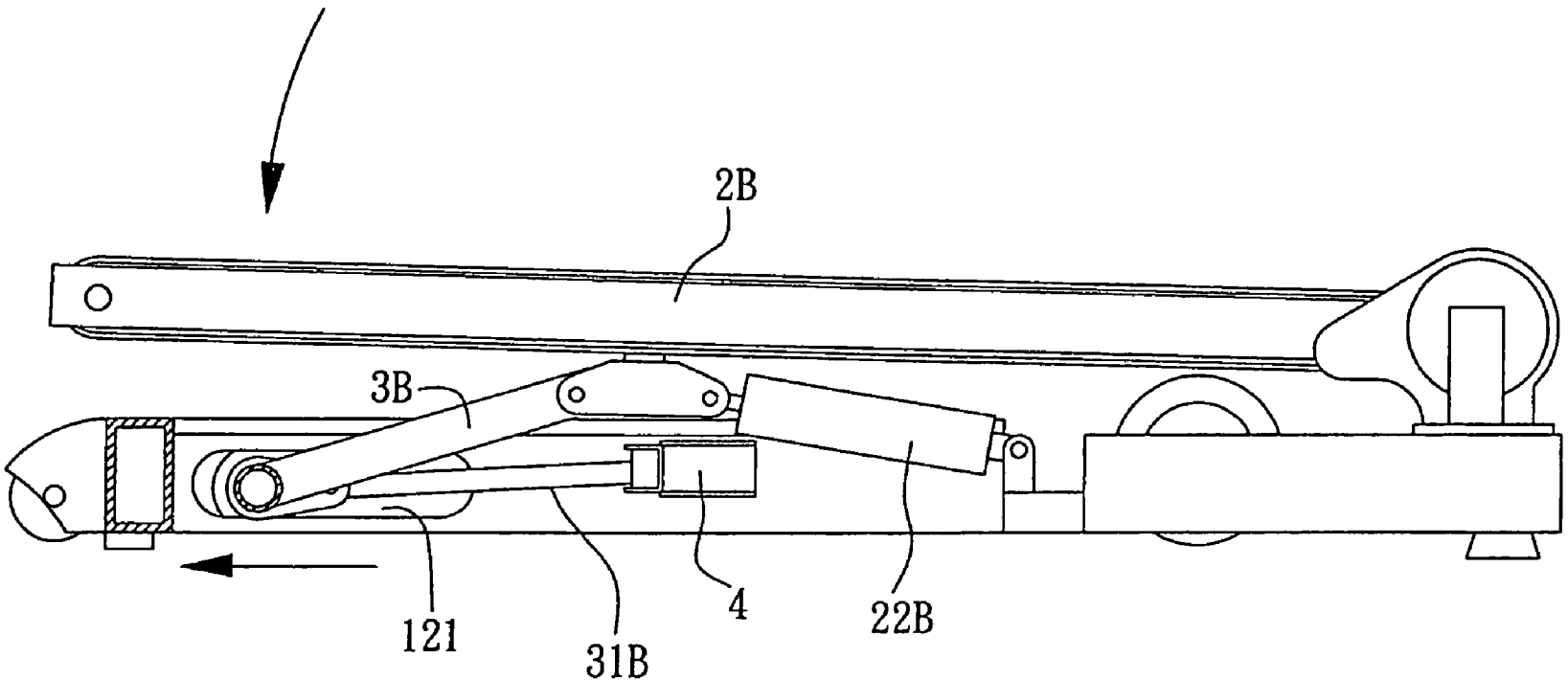
FIG. 4 is a side view of the present invention, showing a using state thereof.
Figure 5:
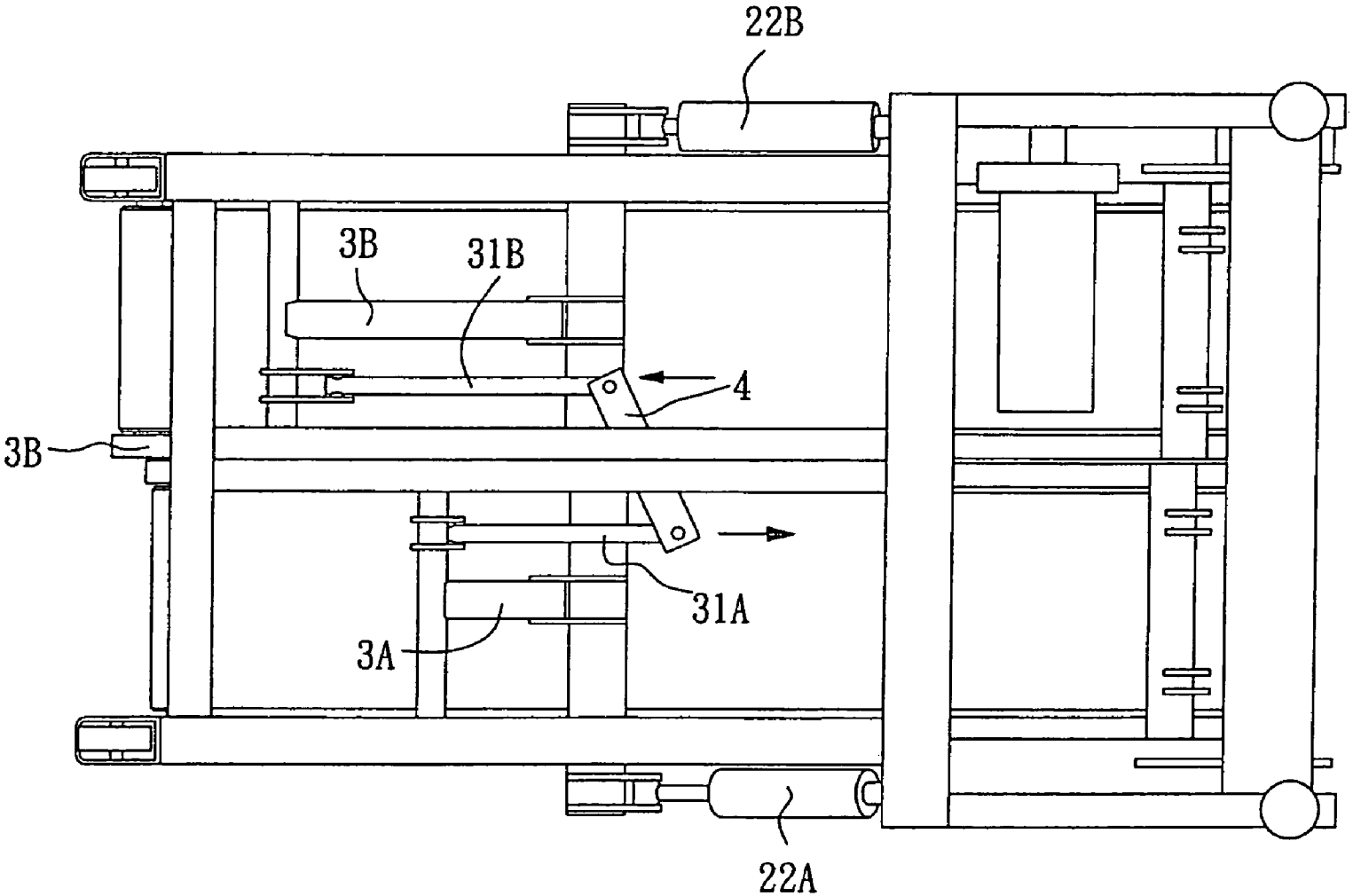
FIG. 5 is a bottom view of the present invention, showing the using state thereof.
Figure 6:
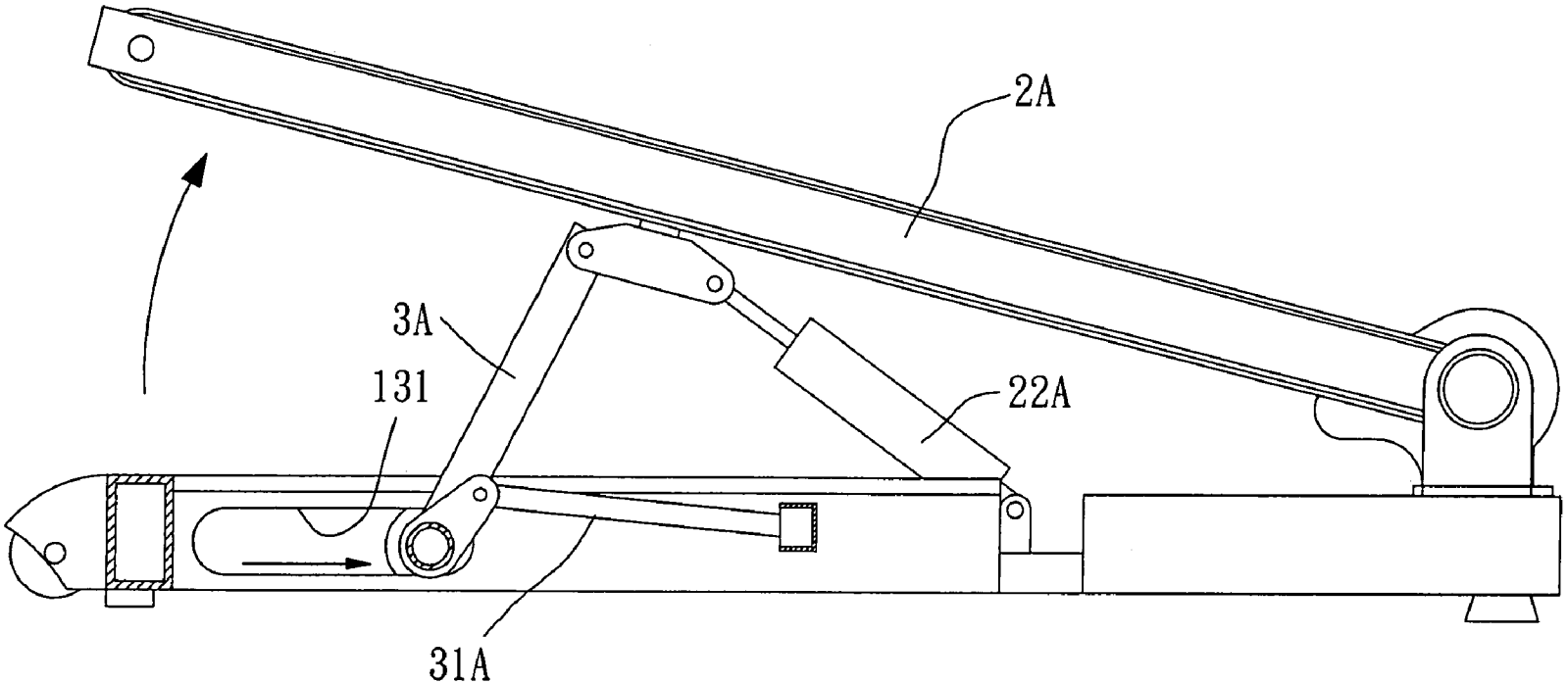
FIG. 6 is a side view of the present invention, showing the using state thereof.

When a user's left foot treads the tread board rack 2B, the tread board rack 2B is swung downward. At this time, the support arm 3B is moved backward within the rail 121 to compress the buffering cylinder 22B as shown in FIG. 4. The rearward moving support arm 3B via the linkage 31B rearward pulls one end of the linking rack 4 corresponding to the tread board rack 2B as shown in FIG. 5. At this time, the other end of the linking rack 4 corresponding to the tread board rack 2A is moved forward. Via the linkage 31A, the support arm 3A is driven to move forward within the rail 131. The support arm 3A cooperates with the buffering cylinder 22A to swing the tread board rack 2A upward as shown in FIG. 6. Therefore, the right foot of the user is lifted. Reversely, when the user's right foot treads the tread board rack 2A, the tread board rack 2B is driven to swing upward. The user's left and right feet can repeatedly alternately tread the tread board racks 2A, 2B to achieve an exercising effect.

The tread board racks 2A, 2B are drivingly connected with the support arms 3A, 3B, linkages 31A, 31B and the linking rack 4 and are reversely alternately swung. The support arms 3A, 3B pivotally connected with the tread board racks 2A, 2B are slid along the slide rails 121, 131 to ensure that the tread board racks 2A, 2B are stably swung.

Figure 7:
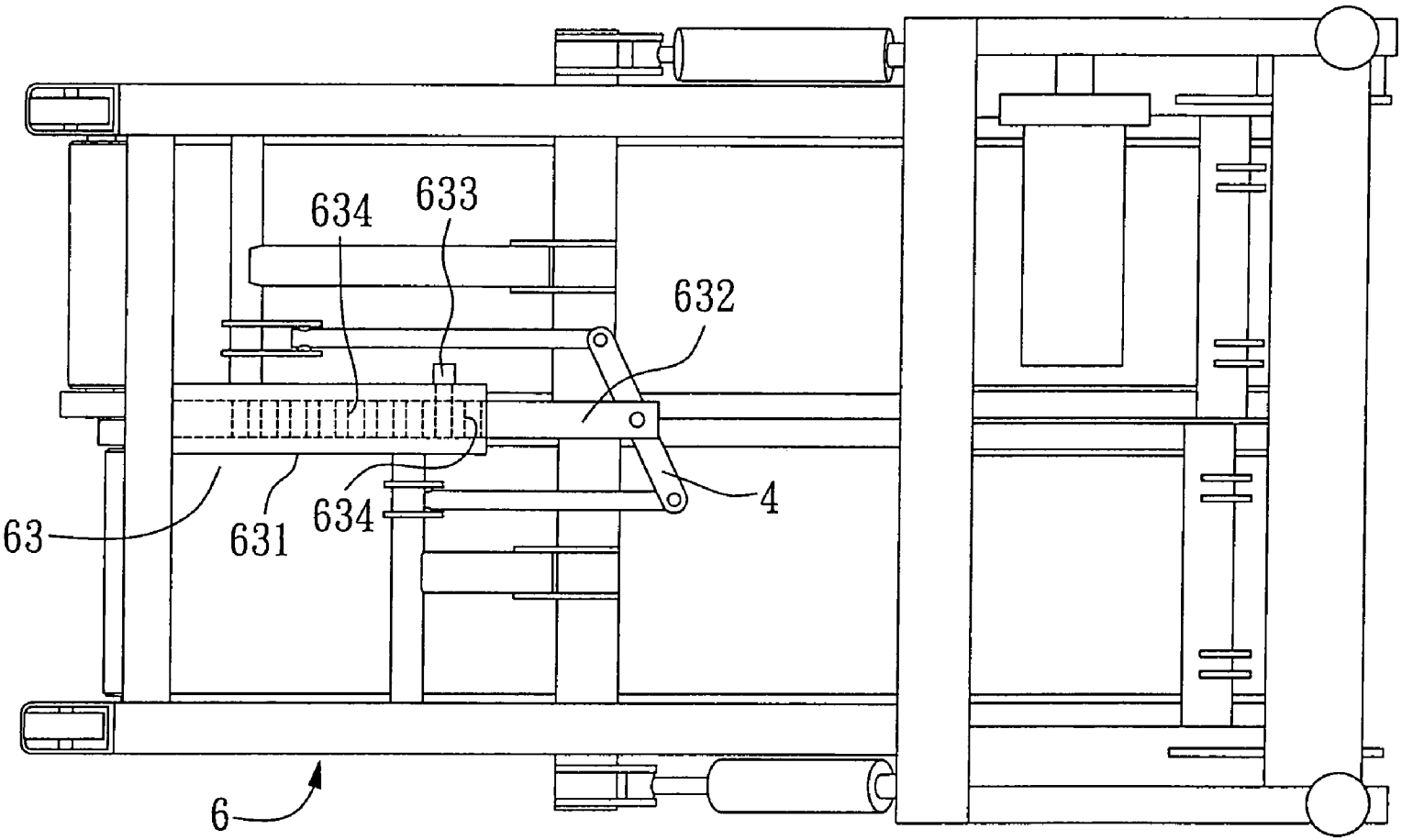
FIG. 7 is a bottom view of a second embodiment of the present invention.

FIG. 7 shows a second embodiment of the present invention, in which the middle beam 63 of the frame assembly 6 is a telescopic rod including an outer tube 631 and an inner tube 632 nested in the outer tube 631. The linking rack 4 is pivotally mounted on the inner tube 632. A locating pin 633 is disposed on the outer tube 631 and the inner tube 632 is formed with several locating holes 634 corresponding to the locating pin 633. The locating pin 633 can be selectively fitted in any of the locating holes 634 to adjust the position of the linking rack 4. This can achieve the same effect as the first embodiment. Moreover, by means of adjusting the position of the linking rack 4, the amplitude of tread board racks can be changed. When the inner tube 632 is totally retracted, even both the support arms can be driven to move backward to downward swing both the tread board racks. Accordingly, the total volume of the treadmill can be reduced to minify the packing material and facilitate storage.

Alternatively, the middle beam can be a telescopic rod in form of an electric thread rod. This can achieve the same effect of the above embodiments.

The above embodiments are only used to illustrate the present invention, not intended to limit the scope thereof. Many modifications of the above embodiments can be made without departing from the spirit of the present invention.

What is claimed is:

1. A linkage structure of a treadmill, comprising a frame assembly and two tread board racks pivotally disposed on the frame assembly side by side, the tread board racks being respectively looped with two circulating belts which are driven by a driving unit to rotate, two buffering cylinders being disposed between the tread board racks and the frame assembly, two support arms being respectively pivotally connected with the tread board racks and slidably mounted in the frame assembly, the support arms being respectively pivotally connected with two linkages, two ends of the two linkages distal from the support arms being respectively pivotally connected with two ends of a linking rack, the linking rack being pivotally mounted in the frame assembly, whereby the side by side arranged tread board racks are drivingly connected with each other to move in reverse directions.

2. The linkage structure of the treadmill as claimed in claim 1, wherein a middle beam is disposed at a center of the frame assembly to divide the frame assembly into a left frame and a right frame, the left and right frames being respectively equipped with two slide rails corresponding to the support arms, whereby the support arms are slidable along the slide rails.

3. The linkage structure of the treadmill as claimed in claim 1, wherein each linkage includes a rocker arm fixed on the support arm and a link pivotally connected with the linking rack and the rocker arm.

4. The linkage structure of the treadmill as claimed in claim 2, wherein the linking rack is pivotally disposed on the middle beam of the frame assembly.

5. The linkage structure of the treadmill as claimed in claim 2, wherein the middle beam of the frame assembly is a telescopic rod and the linking rack is disposed on the middle beam of the frame assembly, whereby by means of telescoping the middle beam, the position of the linking rack is adjustable to change the amplitude of the tread board racks.

6. The linkage structure of the treadmill as claimed in claim 5, wherein the middle beam is a telescopic rod having an electric thread rod for adjusting the position of the linking rack.

7. The linkage structure of the treadmill asclaimed in claim 5, wherein the middle beam of the frame assembly is a telescopic rod including an outer tube and an inner tube nested in the outer tube, the linking rack being pivotally mounted on the inner tube, a locating pin being disposed on the outer tube and the inner tube being formed with several locating holes corresponding to the locating pin, whereby the locating pin can be selectively fitted in any of the locating holes to adjust the position of the linking rack.

* * * * *